US005136128A

United States Patent [19]

Thomas

[11] Patent Number: 5,136,128

[45] Date of Patent: Aug. 4, 1992

[54] HYDRAULICALLY-PILOTED SWITCH

[75] Inventor: Gary Thomas, Fort Collins, Colo.

[73] Assignee: Teledyne Industries, Inc., Fort Collins, Colo.

[21] Appl. No.: 639,882

[22] Filed: Jan. 11, 1991

[51] Int. Cl.[5] ..... H01H 35/24; H01H 35/38

[52] U.S. Cl. ..... 200/81.9 R; 200/82 C

[58] Field of Search ..... 200/81 R, 81.8, 81.9 R, 200/82 R, 82 C

[56] References Cited

U.S. PATENT DOCUMENTS

| | | | |
|---|---|---|---|
| 3,449,535 | 6/1969 | Otto et al. | 200/82 C |
| 4,827,093 | 5/1989 | Strzodka | 200/82 C |
| 4,996,396 | 2/1991 | Smith | 200/81.9 M |

*Primary Examiner*—J. R. Scott
*Attorney, Agent, or Firm*—Hugh H. Drake

[57] ABSTRACT

A hydraulically-piloted switch assembly includes a housing through which runs a hollow conduit that in use contains a fluid under pressure. A linear conduit portion defines a bore one end of which projects away laterally from a portion of the conduit. Slidable sealingly within the bore is a piston. There is an opening in the housing to the exterior atmosphere from the bore with one end of the pistion being movable through the opening to a position exposed beyond the housing. The piston is urged by a compression spring away from the opening to retract the piston end. An elongated leaf spring is secured at one end fo the housing, has an intermediate bend disposed adjacent to the exit of the opening and has its other end defining a finger that projects away from the opening. An outwardly-biased plunger of a microswitch is located in the path of flexure of the finger as the piston end is engaged and disengaged from the bend. The spring rate of the coil spring is selected to determine the actuation of the microswitch by the plunger in correspondence with the pressure level of the fluid relative to atmospheric pressure.

4 Claims, 2 Drawing Sheets

HYDRAULICALLY-PILOTED SWITCH

The present invention pertains to a hydraulically-piloted switch assembly. More particularly, it relates to an assembly wherein there is switch actuation externally to a housing in response to fluid pressure change within the housing but without electrical connection into the interior of the housing.

Sometimes it is desirable to sense a pressure of fluid within a housing or the like with response to a selected level causing an indication to be given such as by the illumination of a light located remotely. One example would be the activation of a lamp on the dashboard of a car in response to a decrease of engine oil pressure below a certain amount. One approach has been to confine an electromechanical switch within a plug, sometimes called a sender, mounted through the engine wall in a manner to expose the switch to the pressurized oil. Electrical conductors are sealed through the body of the plug and lead to the exterior where they connect through a source of power to an indicator light on the dash.

An unnoticed leak in the plug at the point one or both electrical leads are sealed through the plug body has resulted in failure of the driver to become aware of the lack of sufficient oil with the result that the engine has been ruined. It is one object of the present invention to provide a new and improved switch assembly which overcomes that problem.

Another object is to provide a hydraulically-piloted switch assembly that has a mechanical piloting mechanism which is accessible for repair or replacement.

A further object of the present invention is to provide a hydraulically-piloted switch assembly which exhibits durability and stability of operation and yet which is composed of easily made and simply assembled components.

In accordance with one aspect of the present invention, a hydraulically-piloted switch assembly comprises a housing through which runs a hollow conduit and within which is use exists a fluid under pressure. A linear portion of the conduit defines a bore one end of which projects away laterally from a portion of the conduit. A piston is sealingly slidable within that bore. An opening in the housing to the exterior atmosphere from the bore accepts one end of the piston movably through the opening in a position exposed beyond the housing, and a compression spring urges the piston away from that opening to retract the piston end. An elongated leaf spring is secured at one end to the housing, has an intermediate bend disposed adjacent to the exit of the opening and has its other end defining a finger that projects away from the opening; a microswitch has an outwardly-biased plunger located in the path of flexure of the finger as the piston end is engaged and disengaged from the bend. The spring rate of the compression spring is selected to determine the actuation of the microswitch by the plunger in correspondence with pressure level of the fluid relative to atmospheric pressure.

The features of the present invention which are believed to be patentable are set forth with particularity in the appended claims. The organization and manner of operation of one specific embodiment of the invention, together with further objects and advantages thereof, may best be understood by reference to the following description taken in connection with the accompanying drawings, in the several figures of which like reference numerals identify like elements, and in which:

Figure 1:
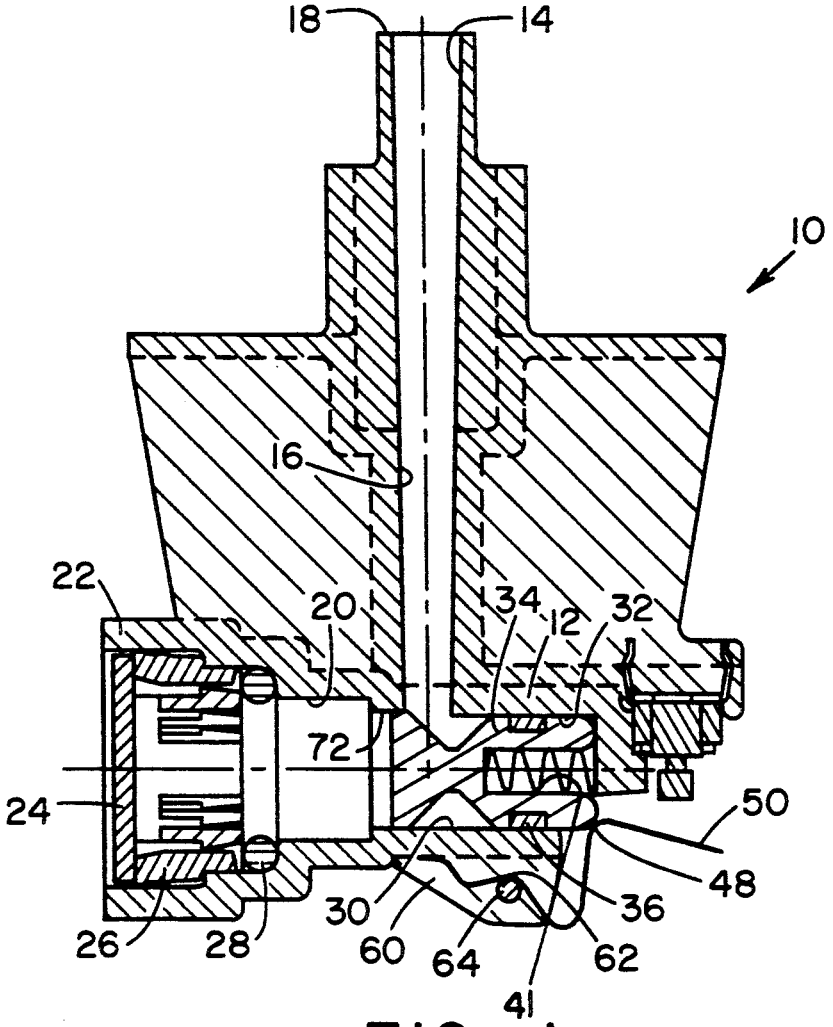
FIG. 1 is a cross-sectional view of a hydraulically-piloted switch which embodies the present invention.

A hydraulically-piloted switch assembly 10 includes a housing 12 which has a hollow conduit 14 running through housing 12 and within which in use exists a fluid under pressure. Conduit 14 has a first leg 16 which begins at a coupling 18 and intermediately turns laterally into a leg 20 which terminates in a coupling 22.

Coupling 22 is completed by a connector assembly which includes a collet 24, a cartridge insert 26 and an O-ring 28 collectively available in the marketplace from John Guest USA, Inc. and serving to accept and grab the free end of a flexible hose (not shown). Coupling 18 is in this case a simple nipple on which a hose is to be seated and clamped in place. The specific mode of coupling is of no significance to the present invention.

Figure 2:
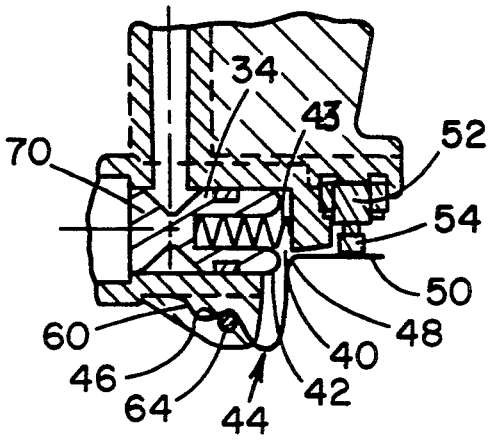
FIG. 2 is a fragmentary-similar cross-sectional view but with certain of the components in a different position.
Figure 3:
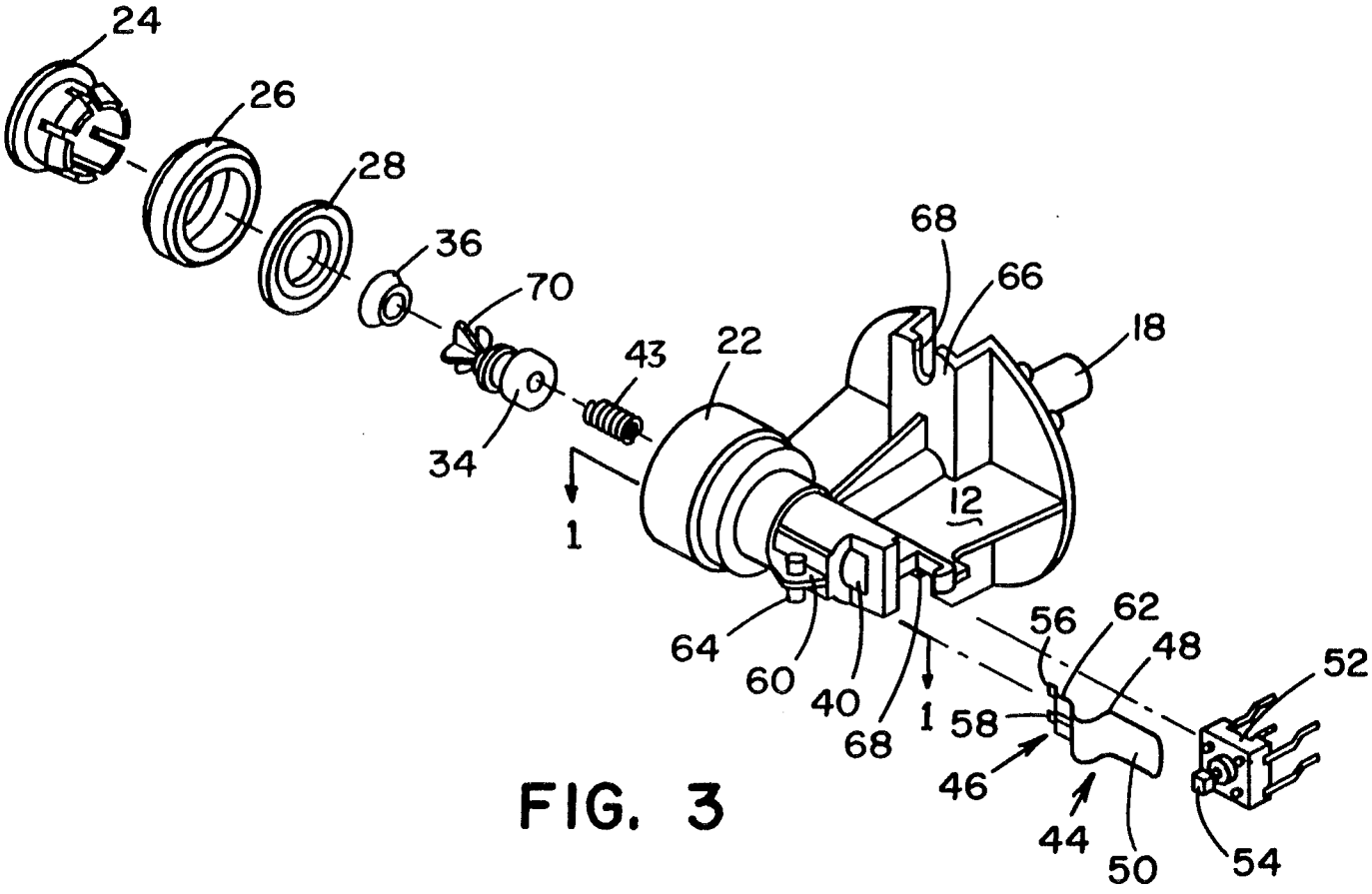
FIG. 3 is an exploded isometric view of the switch of FIGS. 1 and 2, FIG. 1 having been taken as if along the line 1—1 in FIG. 3 with its parts not exploded.

Leg 20 defines a linear portion of conduit 14 and defines a bore 30 one end 32 of which projects away laterally from leg 14. A piston 34 is sealed by an O-ring 36 to slide within bore 32. While O-ring 36 as shown in FIGS. 1 and 2 is an ordinary O-ring, the seal preferably is of the improved variety in the form of an annulus with a peripheral lip as shown in FIG. 3.

At the otherwise closed end and to one side of bore 32 is an opening 40 in the housing which communicates to the exterior atmosphere from the bore. As may be observed by comparing FIGS. 1 and 2, one end 42 of piston 34 is movable through opening 40 to a position exposed beyond the housing. A well 41 in end 42 seats a compression spring 43 which urges piston 34 in a direction away from opening 40 to retract piston end 42.

An elongated leaf spring 44 is secured at one end 46 to housing 12 and has an intermediate bend 48 disposed adjacent to the exit of opening 40. From bend 48 the other end of leaf spring 44 defines a finger 50 projecting away from opening 40.

Secured onto housing 12 is a microswitch 52 with an outwardly biased plunger located in the path of flexure of finger 50 as piston 34 is engaged and disengaged from bend 48. Microswitch 54 may be either normally open or normally closed, depending upon the task assigned.

Leaf spring 44 has its one end portion 46 bifurcated into a parallel-spaced pair of prongs 56 and 58 which mount on either side of a blade 60 outwardly projecting from housing 12. A reverse curve 62 in each prong seats under a pin 64 projecting laterally from each side of blade 60 and represented for clarity in FIGS. 1 and 2 even though one technically is looking at the middle plane of blade 60. Blade 60 together with the bifurcation stabilizes the location of leaf spring 44.

For operation, the spring rate of coil-type compression spring 42 is selected to determine the actuation point of microswitch 52 by plunger 54 in correspondence with a predetermined pressure level of the fluid in conduit 14 relative to the atmospheric pressure outside opening 40. In one successful implementation, switch assembly 10 has been utilized in the reverse osmosis system described and claimed in U.S. patent application Ser. No. 466,077 filed Jan. 16, 1989 to Peace et al and assigned to the same assignee as the present application.

There, the switch senses the pressure in a permeate line leading to an outlet faucet. Switch assembly 10 senses the sudden pressure change which occurs between opening and closing of that faucet. The electric signal is fed to an associated microproccessor for use in connection with system evaluation and performance indication.

In principle the overall shape and other external features of housing 12 are in no way restricted to that shown. In this particular case, a channel 66 includes slots 68 at each end for the receipt of screws that mount housing 12 to an associated valve module in the case of the embodiment of that co-pending application.

Carried on the end of piston 34 opposite opening 40 and piston end 42 is a longitudinally-fluted tail portion 70. The fluting allows the liquid to flow freely around tail 70 and the fluted portion rides within the short portion 72 of bore 30 which continues beyond the wall of leg 16. This stabilizes the travel of the piston and ensures against its dislogement. That is another purpose of collet 24 and its inwardly-extending fingers. On the other hand, collect 24 and cylinder 26 may be removed in order to permit piston 32 to be retrieved for purposes of cleaning or replacement.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A hydraulically-piloted switch assembly comprising:

a housing:

a hollow conduit running through said housing and within which in use exists a fluid under pressure;

a linear portion of said conduit defining a bore one end of which projects away laterally from a portion of said conduit;

a piston sealingly slidable within said portion of said bore;

an opening in said housing to the exterior atmosphere from said bore with one end of said piston movable through said opening to a position effectively exposed beyond said housing;

a compression spring urging said piston away from said opening to retract said one end;

an elongated leaf spring secured at one end to said housing, having an intermediate bend disposed adjacent to the exit of said opening and having its other end defining a finger projecting away from said opening;

a housing-mounted microswitch with an outwardly-biased plunger located in the path of flexure of said finger as said piston one end is engaged and disengaged from said bend;

and the spring rate of said compression spring being selected to determine the actuation of said microswitch by said plunger in correspondence with a predetermined pressure level of said fluid relative to atmospheric pressure.

2. A hydraulically-piloted switch assembly as defined in claim 1 in which the other end of said piston includes a fluted tail around which fluid may flow and which is guided in a continuation of said bore.

3. A hydraulically-piloted switch assembly as defined in claim 1 in which a coupling at one end of said conduit faces said piston and is removable for removal of said piston.

4. A hydraulically-piloted switch assembly as defined in claim 1 in which said one end portion of said leaf spring is longitudinally bifurcated and in which a blade projecting away from said housing seats within the prongs of the bifurcation.

* * * * *